US012667231B1

(12) United States Patent
King

(10) Patent No.: US 12,667,231 B1
(45) Date of Patent: Jun. 30, 2026

(54) SYSTEM AND METHOD FOR BATHING IMMOBILE OR PARTIALLY IMMOBILE INDIVIDUAL

(71) Applicant: CLEAN BOX ENTERPRISE INC.

(72) Inventor: Terrance A. King, Lakeland, FL (US)

( * ) Notice: Subject to any disclaimer, the term of this patent is extended or adjusted under 35 U.S.C. 154(b) by 135 days.

(21) Appl. No.: 18/381,962

(22) Filed: Oct. 19, 2023

Related U.S. Application Data

(60) Provisional application No. 63/417,378, filed on Oct. 19, 2022.

(51) Int. Cl.
*A47K 3/022* (2006.01)

(52) U.S. Cl.
CPC ..... *A47K 3/022* (2013.01)

(58) Field of Classification Search
CPC . A61H 2035/004; A47K 3/022; A61G 7/0005
See application file for complete search history.

(56) References Cited

U.S. PATENT DOCUMENTS

| | | | | |
|---|---|---|---|---|
| 7,189,193 | B2 * | 3/2007 | Egger | A63B 22/0605 482/57 |
| 10,434,020 | B2 * | 10/2019 | Sason | A61G 7/015 |
| 11,064,845 | B2 * | 7/2021 | Lee | A47K 3/001 |
| 11,497,665 | B2 * | 11/2022 | Matters | A61G 5/1075 |

* cited by examiner

*Primary Examiner* — Janie M Loeppke

(57) ABSTRACT

A system having an enclosure having at least one movable component that can be opened for an individual to be placed within the enclosure and then closed when the individual is within the enclosure. A cleaning system functioning within the enclosure to at least one of dispense a liquid through at least one opening and physically contact the user to wipe the individual, a resting area where the individual is positioned with the upper torso of the individual arranged between at least one of in a prone position to a vertical position and a control device to control the cleaning system.

16 Claims, 14 Drawing Sheets

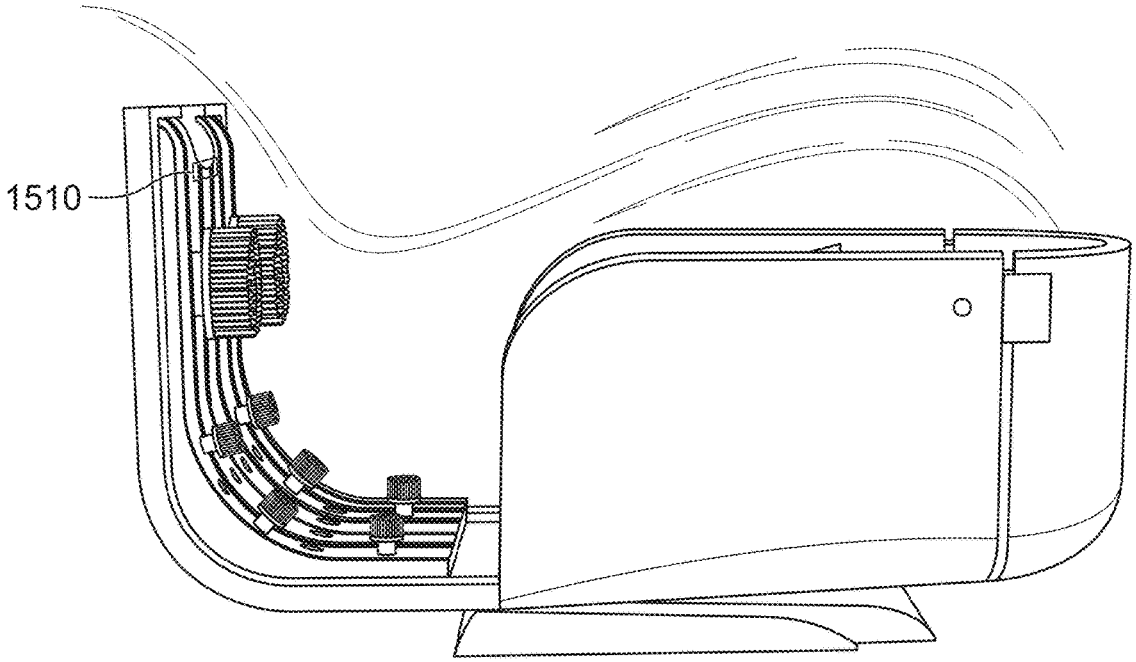

FIG. 18

1610 controlling a bathing process of an enclosure having at least one movable component that can be opened for an individual to be placed within the enclosure and then closed when the individual is within the enclosure by controlling a cleaning system within the enclosure to at least one of dispense a liquid through at least one opening within the structure and to physically contact the user with at least one brush, with a processor that is part of a controller that has a user interface.

FIG. 19

SYSTEM AND METHOD FOR BATHING IMMOBILE OR PARTIALLY IMMOBILE INDIVIDUAL

BACKGROUND

Embodiments relate generally to the field of bathtubs and more specifically to a machine and or a process that will provide self-cleaning an individual placed within the machine.

Bathing, an integral aspect of daily life, holds particular significance in preserving personal hygiene and well-being. However, for disabled individuals, this seemingly mundane routine can become a complex challenge due to limited mobility, impaired motor functions, and other physical constraints. These difficulties not only compromise their hygiene but also impact their independence, self-esteem, and overall quality of life. In response to these challenges, innovative solutions are being sought that cater to the specific needs of disabled individuals, aimed at enhancing their autonomy and comfort. Traditional bathing methods, often reliant on caregiver assistance, can be physically demanding and emotionally taxing, affecting both the individuals and their caregivers.

Depending on a condition of an individual, bathing in a prior art bathtub or shower is not possible. For example, due to physical limitations that the individual may have such as, but not limited to, with respect to their mind, or a part of their body, the individual may not be able to bathe in a bathtub or shower unassisted. In such situations, the individual may be assisted into either the bathtub or shower to be bathed. In other situations, a caregiver may have to provide a sponge bath. Depending on the attention to detail provided by the caregiver or person providing assistance, the individual may not be fully cleaned.

Individuals unable to bathe themselves independently or caregivers responsible for bathing another individual would benefit from a system and method that provides for the individual being placed at a location where the cleaning process is performed independent of the individual or caregiver. Thus, the demand for technological interventions that can address these challenges has gained prominence.

SUMMARY

Embodiments relate to a system and a method for cleaning an individual placed within the system. The system comprises an enclosure having at least one movable component that can be opened for an individual to be placed within the enclosure and then closed when the individual is within the enclosure, a cleaning system functioning within the enclosure to at least one of dispense a liquid through at least one opening and physically contact the user to wipe the individual, a resting area where the individual is positioned with the upper torso of the individual arranged between at least one of in a prone position to a vertical position and a control device to control the cleaning system.

The method comprises a method for bathing an individual, the method comprises controlling a bathing process of an enclosure having at least one movable component that can be opened for an individual to be placed within the enclosure and then closed when the individual is within the enclosure by controlling a cleaning system within the enclosure to at least one of dispense a liquid through at least one opening within the structure and to physically contact the user with at least one brush, with a processor that is part of a controller that has a user interface.

BRIEF DESCRIPTION OF THE DRAWINGS

A more particular description briefly stated above will be rendered by reference to specific embodiments thereof that are illustrated in the appended drawings. Understanding that these drawings depict only typical embodiments and are not therefore to be considered to be limiting of its scope, the embodiments will be described and explained with additional specificity and detail through the use of the accompanying drawings in which:

FIG. 18 shows an embodiment of a side view of the enclosure;

FIG. 19 shows a process block for a method disclosed herein; and

DETAILED DESCRIPTION

Figure 1:
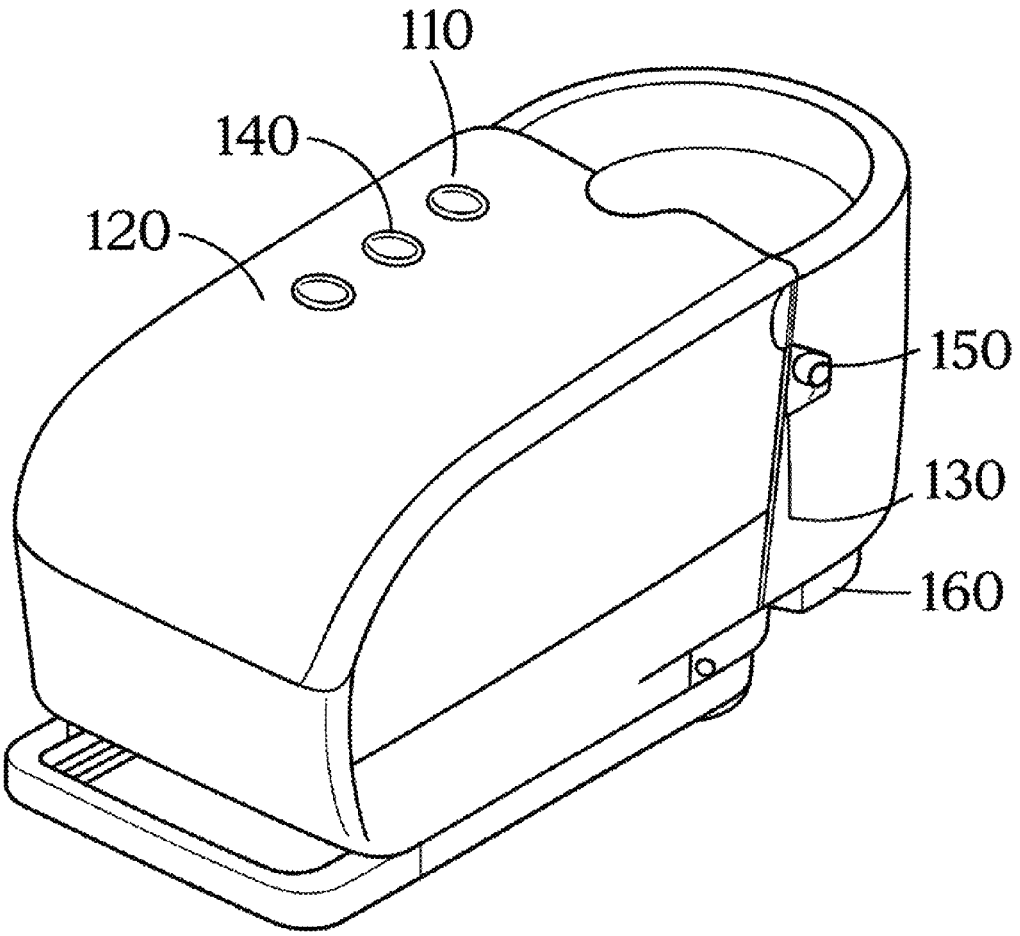
FIG. 1 shows an embodiment of a system in a closed configuration.

Embodiments are described herein with reference to the attached figures wherein like reference numerals are used throughout the figures to designate similar or equivalent elements. The figures are not drawn to scale and they are provided merely to illustrate aspects disclosed herein. Several disclosed aspects are described below with reference to non-limiting example applications for illustration. It should be understood that numerous specific details, relationships, and methods are set forth to provide a full understanding of the embodiments disclosed herein. One having ordinary skill in the relevant art, however, will readily recognize that the disclosed embodiments can be practiced without one or more of the specific details or with other methods. In other instances, well-known structures or operations are not shown in detail to avoid obscuring aspects disclosed herein. The embodiments are not limited by the illustrated ordering of acts or events, as some acts may occur in different orders and/or concurrently with other acts or events. Furthermore, not all illustrated acts or events are required to implement a methodology in accordance with the embodiments.

Notwithstanding that the numerical ranges and parameters setting forth the broad scope are approximations, the numerical values set forth in specific non-limiting examples are reported as precisely as possible. Any numerical value, however, inherently contains certain errors necessarily resulting from the standard deviation found in their respective testing measurements. Furthermore, unless otherwise clear from the context, a numerical value presented herein has an implied precision given by the least significant digit. Thus, a value 1.1 implies a value from 1.05 to 1.15. The term "about" is used to indicate a broader range centered on the given value, and unless otherwise clear from the context implies a broader range around the least significant digit, such as "about 1.1" implies a range from 1.0 to 1.2. If the least significant digit is unclear, then the term "about" implies a factor of two, e.g., "about X" implies a value in the range from 0.5× to 2×, for example, about 100 implies a value in a range from 50 to 200. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 4.

Embodiments disclosed herein provide for a system and method for cleansing and rejuvenation an individual, especially if the individual is unable to bathe themselves or require a caregiver to assist in the bathing process to foster independence and preserves dignity, ensuring constant peace of mind, safety, and comfort of the individual bathing.

FIG. 1 shows an embodiment of the system with the side in a closed position. As shown, the system 100 has an enclosure 110. As shown in later figures, the enclosure 110 has a movable component 120, wall, top or side, that is able to be opened so that an individual can enter the enclosure 110. The enclosure 110 has an opening 130 for the individual's head to extend from the enclosure 110 when enclosed. In this embodiment, the individual's upper body may be in a vertical or nearly vertical position, depending on an angle of the seat and its associated back support, shown in a later figure. The seat may adjust from vertical to a prone position for the individual's toro. A plurality of water injection holes 140 are also visible. Also visible is a control device, or control panel 150, and a base 160 of the enclosure 110.

Figure 2:
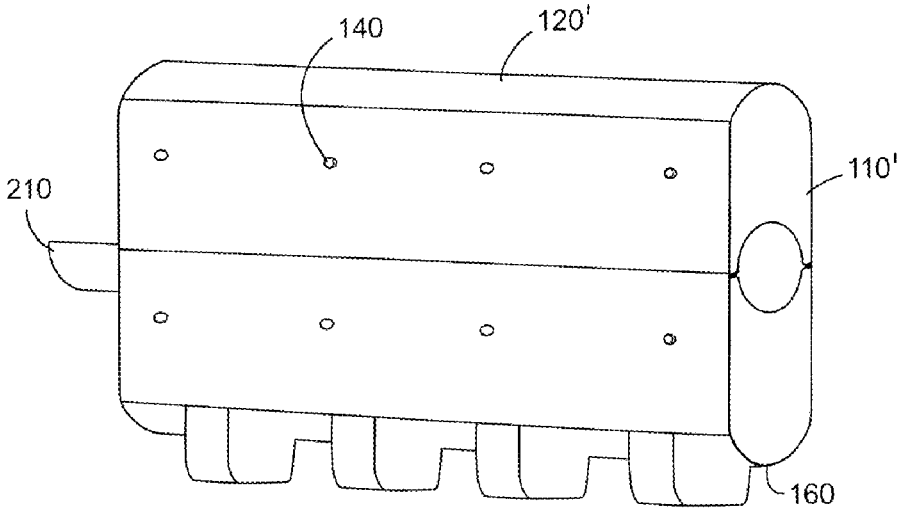
FIG. 2 shows another embodiment of the system in a closed configuration.

The arrangement or configuration of the enclosure is non-limiting. For example, FIG. 2 shows another embodiment of the system 100' showing the enclosure 110'. In this embodiment, a shelf 210 or head support is provided for the individual's head to rest upon when within the enclosure 110'. In this configuration, the individual is in a prone position within this embodiment of the enclosure 110.

Figure 3:
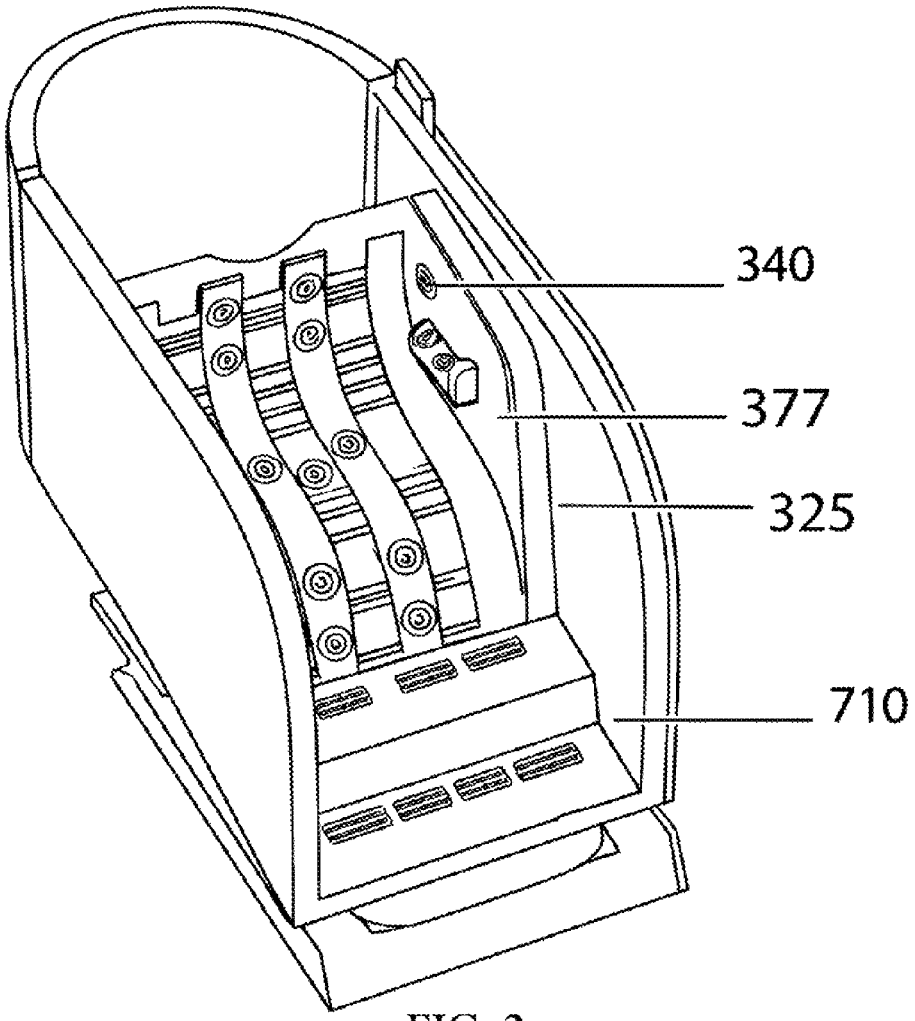
FIG. 3 shows an embodiment of the system of FIG. 1 without the movable component.

FIG. 3 shows an embodiment of the system of FIG. 1 without the movable component. As shown and discussed further herein, elements of a cleaning subsystem 325, namely the rolling device and water jets nozzles 340 or water jets may be included in the resting area. Also shown is an arm rest 377. Water jets 340 may also be a part of the arm rest 377.

Figure 4:
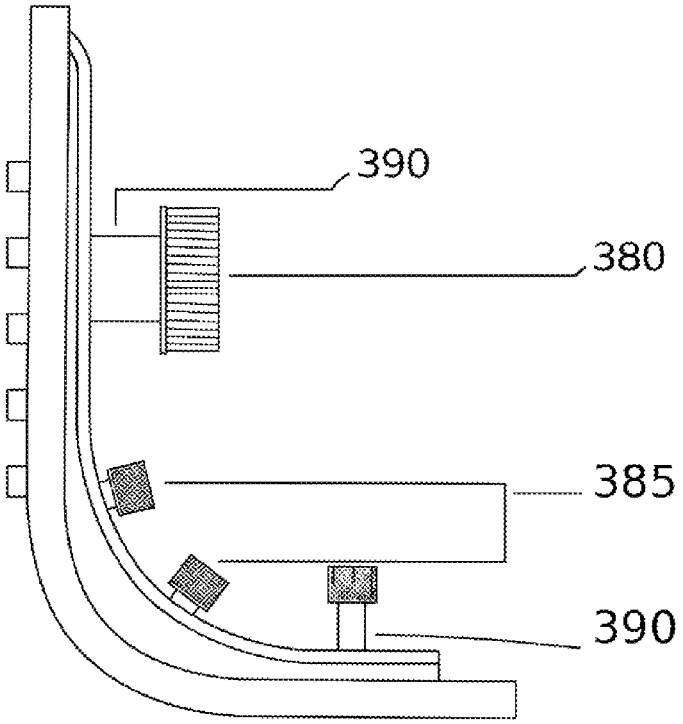
FIG. 4 shows a side view of the movable component.

FIG. 4 shows a side view of the movable component. As shown and discussed further herein, additional elements of the cleaning subsystem 325, namely the brushes 380, 385 along with each brushes' respective puller or handle 390.

Figure 5:
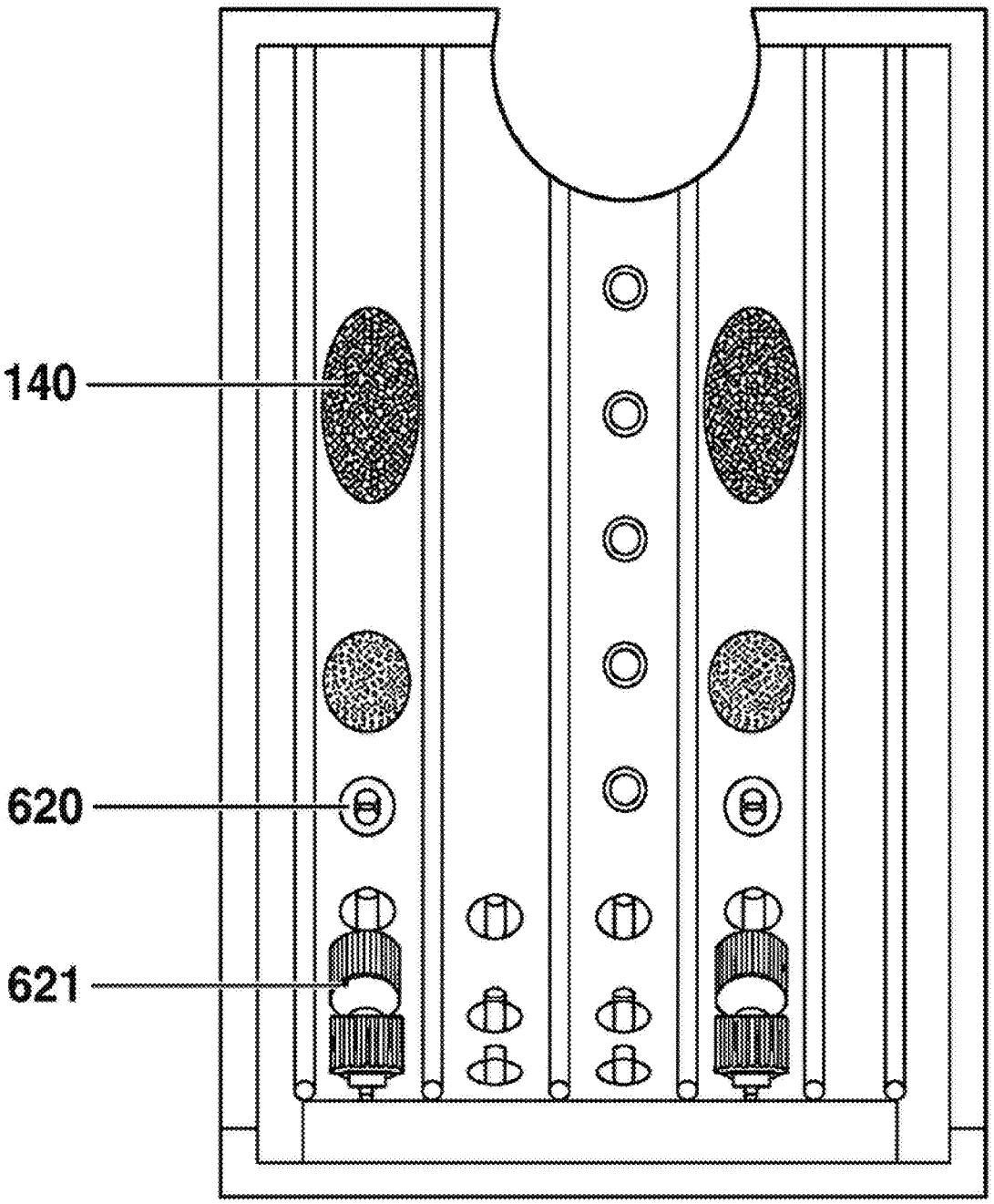
FIG. 5 shows a front view of the movable component.

FIG. 5 shows a front view of the inside surface of the movable component. In addition to the elements shown above with respect to FIG. 4, water injection holes 140 are also shown. All shown are lights 620 that are part of a lighting subsystem 621 or system, which is further discussed herein.

Figure 6:
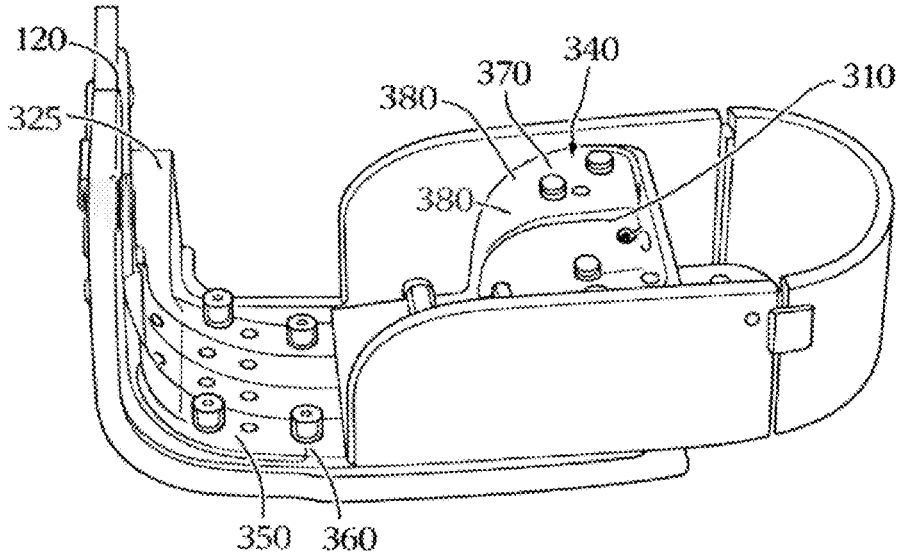
FIG. 6 shows an embodiment of the system shown in FIG. 1 in an opened configuration.

FIG. 6 shows an embodiment of the system shown in FIG. 1 in an opened configuration. As shown, the movable component 120, or top, is fully opened. A sitting area 310 or resting area is shown. As disclosed above, the resting area 310 may be arranged so that the individual's torso is anywhere from being in a vertical position to a prone position. As is visible in FIG. 1, as a non-limiting example, the enclosure 110 may provide room for an individual to be in a prone position. The resting area 310 has a base 320 for the individual to sit upon and may have a back support 330. The back support 330 may be arranged or may be adjustable to vary whether the individual is sitting fully vertical or is declined at an angle.

A cleaning system 325, or subsystem is available. The cleaning system may comprise a liquid dispensing subsystem and a subsystem that physically makes contact with the individual to clean the surface of the individual. More specifically, also visible are a plurality of water jets 340. The water jets 340 are shown on the seating area 310. The placement of the water jets 340 is non-limiting. As a non-limiting example, the water jets 340 may also be provided on an inner wall 350 of the enclosure or on the inside wall of the movable component 120. A roller device 360 is also shown. In the embodiment shown, at least two roller devices 360 are provided, parallel to each other on the base 320 of the seating area 310. As further shown, the roller devices 360 may extend from the base 320 of the seating area 310 to the back support 330.

The inner surface or inside wall 370 of the movable component 120 is also visible. A plurality of brushes or scrubbers 380, 385 are provided. The brushes 380, 385 may be of various sizes. Each brush 380, 385 may include a handle 390 which may extend from the inner wall 370 when the brush 380, 385 is activated. When activated, the brush 380, 385 may move such as, but not limited to, in a rotationally, gyrationally, pulsating motion, etc., during and/or after the handle extends the brush 380, 395 from the inner wall 370.

Figure 7:
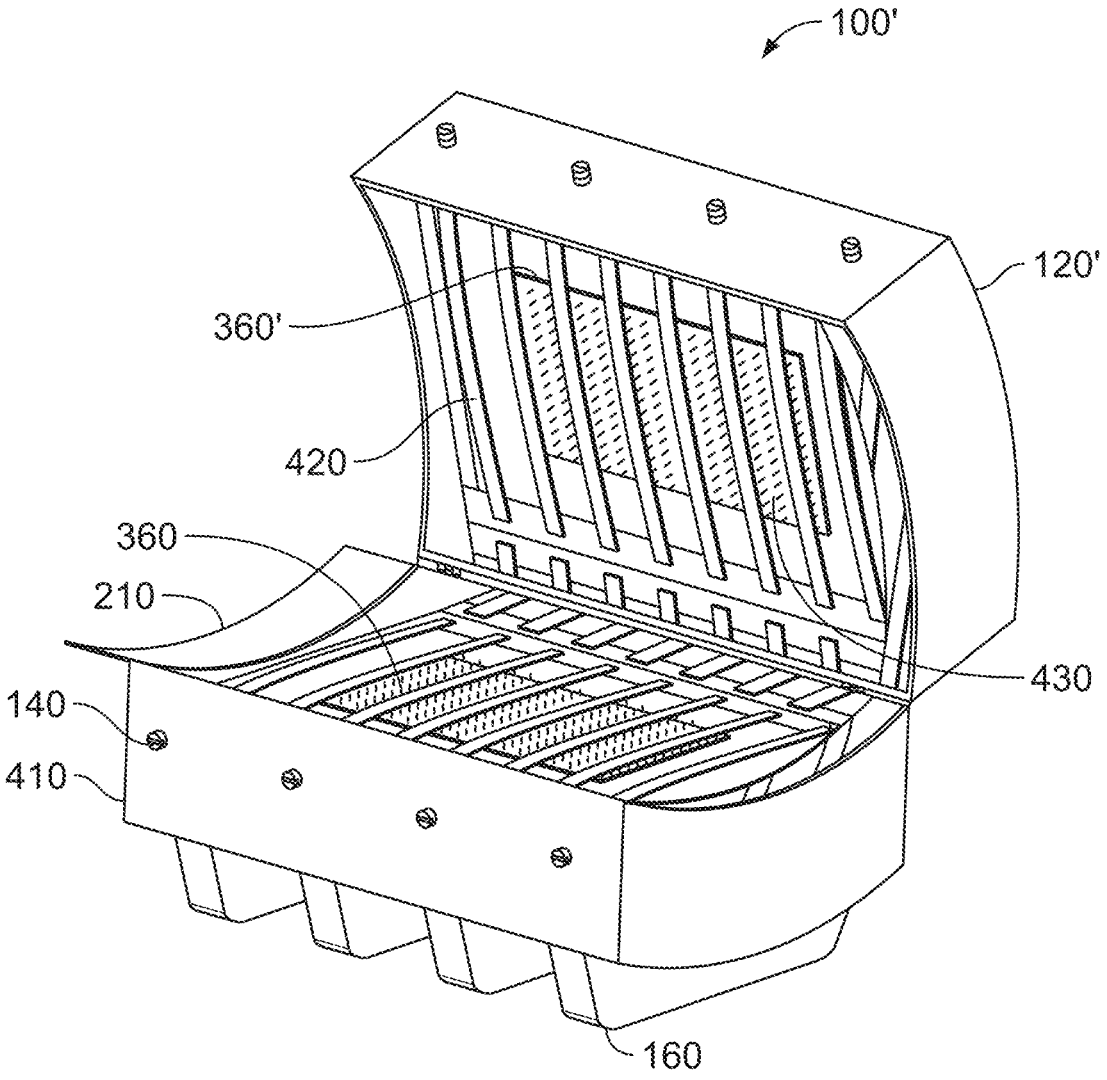
FIG. 7 shows an embodiment of the system shown in FIG. 2 in an opened configuration.

FIG. 7 shows an embodiment of the system shown in FIG. 2 in an opened configuration. As discussed above, this embodiment is for the individual who needs to be in a prone position. The roller device 360' is located on an inner surface of a base part 410 of the enclosure 110' and the inner surface 370' of the movable component 120' or top. A plurality of straps 420 are provided to secure the scrubber or cloth 430 on the roller device 360'. The straps 420 may also function as rope jets. As rope jets, liquid may be dispensed through the straps 420. As discussed herein, the straps 420 are configured so that the liquid may be dispensed at a variable pressure.

Figure 8:
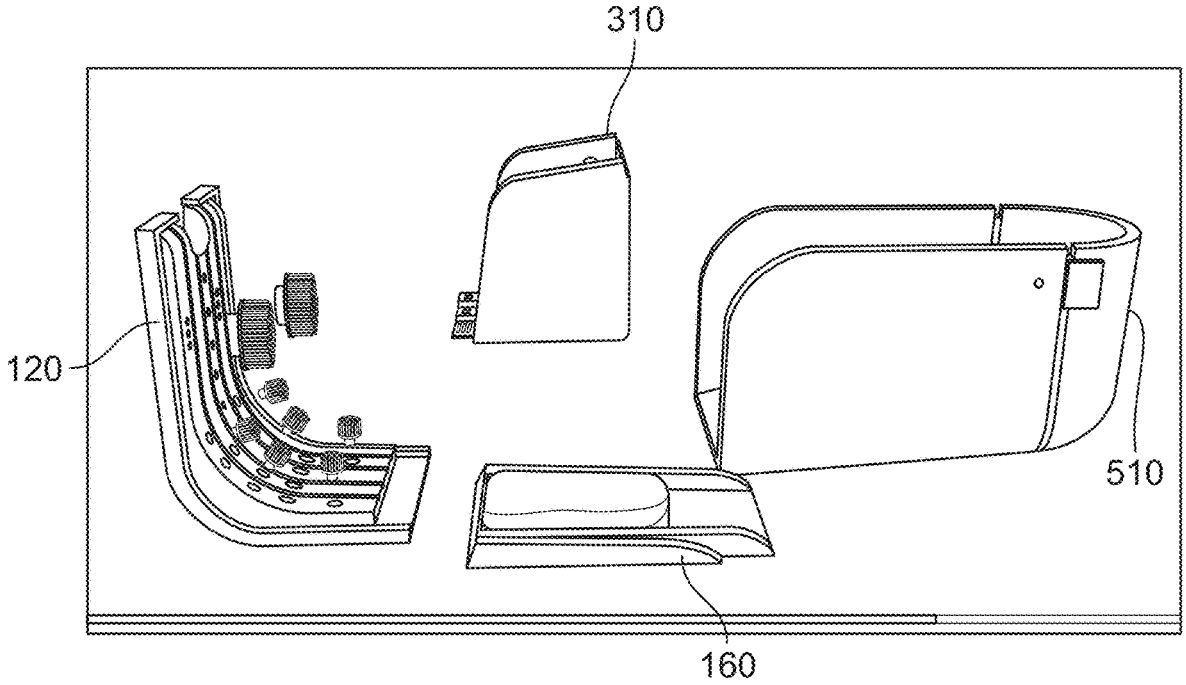
FIG. 8 shows an embodiment of the system where various parts are separated.

FIG. 8 shows an embodiment of the system where various parts are separated. Separated, the movable component 120, base 160, seating area 310 and a tub area 510 are shown. The base 160 may be configured to allow the enclosure, specifically the tub area 510 which is attached to the base 160 to be rotated about the base either horizontally or vertically. This movement may be performed either when the movable component 120 is in an opened position or closed position. Hence, the tub area 510 may be able to, such as, but not limited to, vibrate during operation. The base 160 may also be mechanized to lift and lower the enclosure 110. As a non-limiting example, the base can cause the enclosure 110 to be lifted at an angle where the tub area 510 is at a higher height than where the tub area 510 connects to the moveable component 120. This arrangement may assist with an individual entering and exiting the enclosure 110.

Figure 9:
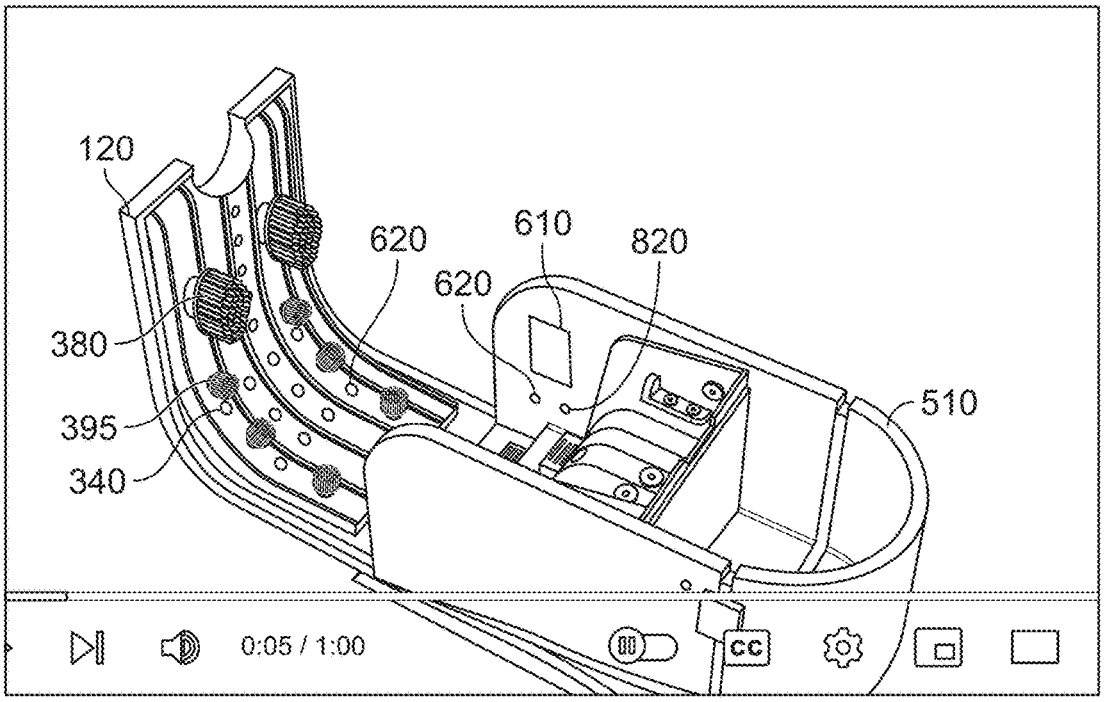
FIG. 9 shows an embodiment of the system shown in FIG. 6 from a second perspective.

FIG. 9 shows an embodiment of the system shown in FIG. 6 from a second perspective. From this view, the brushes 380, 385 are further visible on the inner wall 370 of the movable component 120. Water jets 340 may also be located on the inside wall 370 of the movable component 120. Sensors 610 and lighting devices 620 are also shown but will be discussed later herein. Though the term "water jets" is used herein, this term is not meant to be limiting. Specifically, though water is used in the description, any liquid may be dispensed with such as, but not limited to, water with a cleaning (soap) solution, etc.

Figure 10:
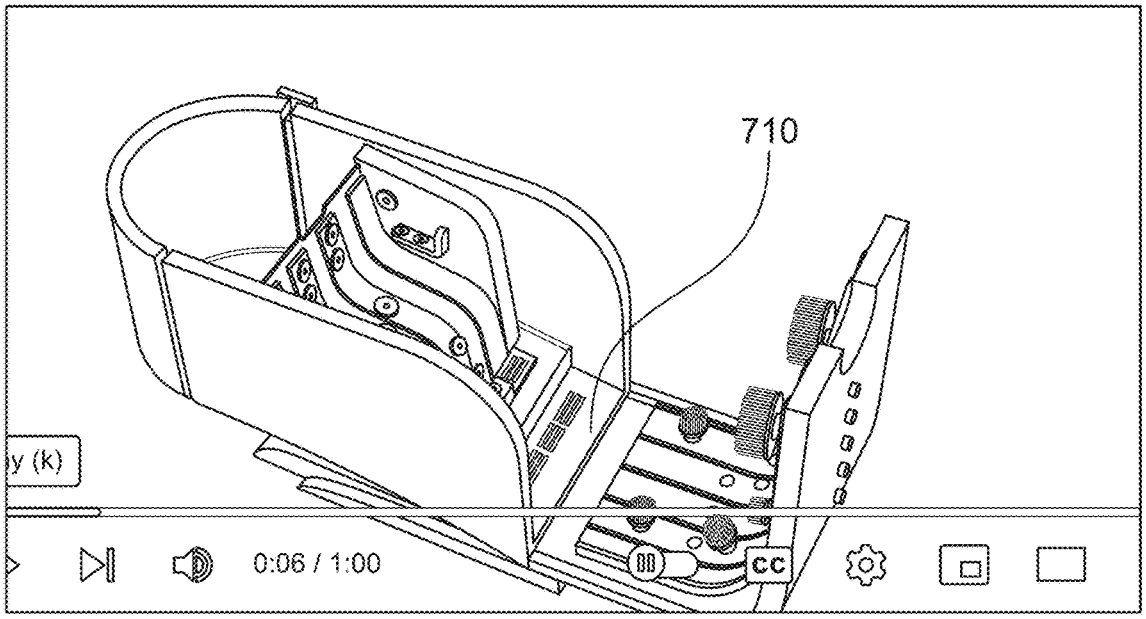
FIG. 10 shows an embodiment of the system shown in FIG. 6 from a third perspective.

FIG. 10 shows an embodiment of the system shown in FIG. 6 from a third perspective. A visible drain area 710 is provided. The drain area is non-limiting as it may also be provided behind the seating area 310.

Figure 11:
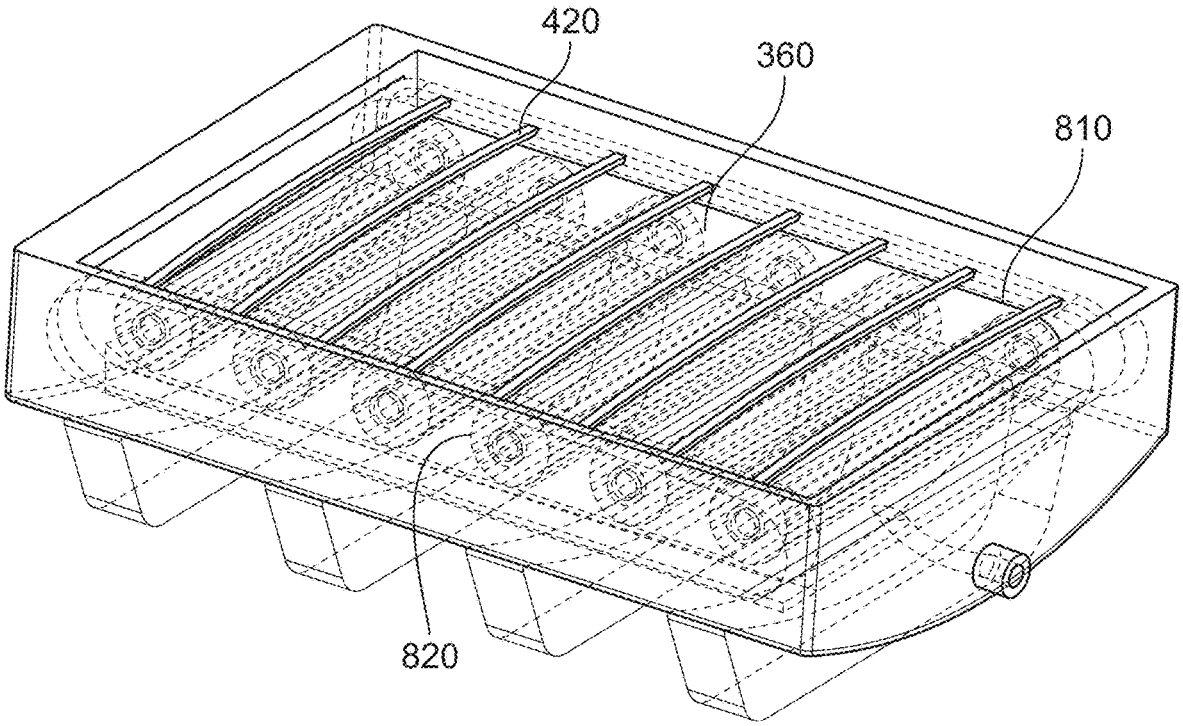
FIG. 11 shows a base part of the system shown in FIG. 7.
Figure 12:
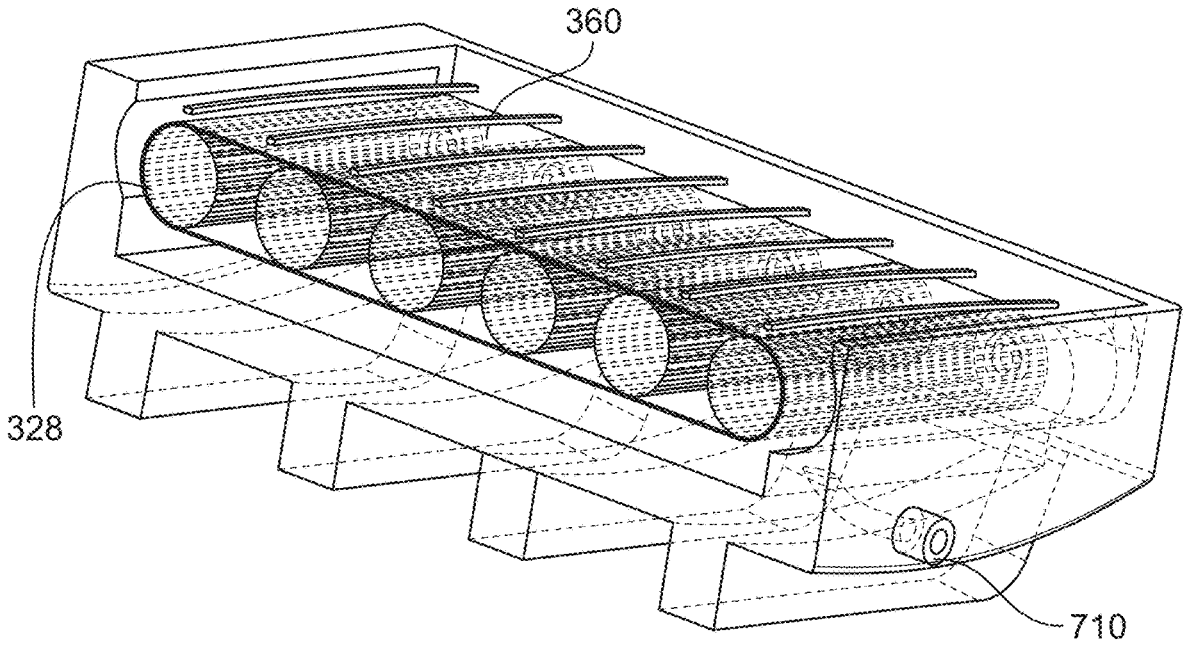
FIG. 12 shows the base part of the system shown in FIG. 11 with a side of the base removed.

FIGS. 11 and 12 show a base part of the system shown in FIG. 7. The functionality discussed with respect to FIGS. 8 and 9 is applicable to each embodiment 100, 100' disclosed herein. The rolling device 360, 360' or conveyor belt may have a conveying element such as, but not limited to, a belt 810 to which the cloth 430 may be attached or integrated. The belt 810 may be transitioned about a plurality of rollers 820. The belts may run in a same direction or reverse direction. When multiple rolling devices are used, the devices may operate in the same direction or different directions.

Specific to the embodiment disclosed in FIGS. 11 and 12, one rolling device 360' scrubs the individual's backside while the second rolling device 360' scrubs the individual's frontside. With respect to the system 100' shown in FIG. 2, the individual may lay on the individual's back when within the system 100' or on the individual's front side. Placement may be determined based on any physical limitation the individual has. When laying on the frontside, the headrest may be configured so that the individual may place their head facedown. Thus, the headrest may have an opening through which the individual may see and breath.

Figure 13:
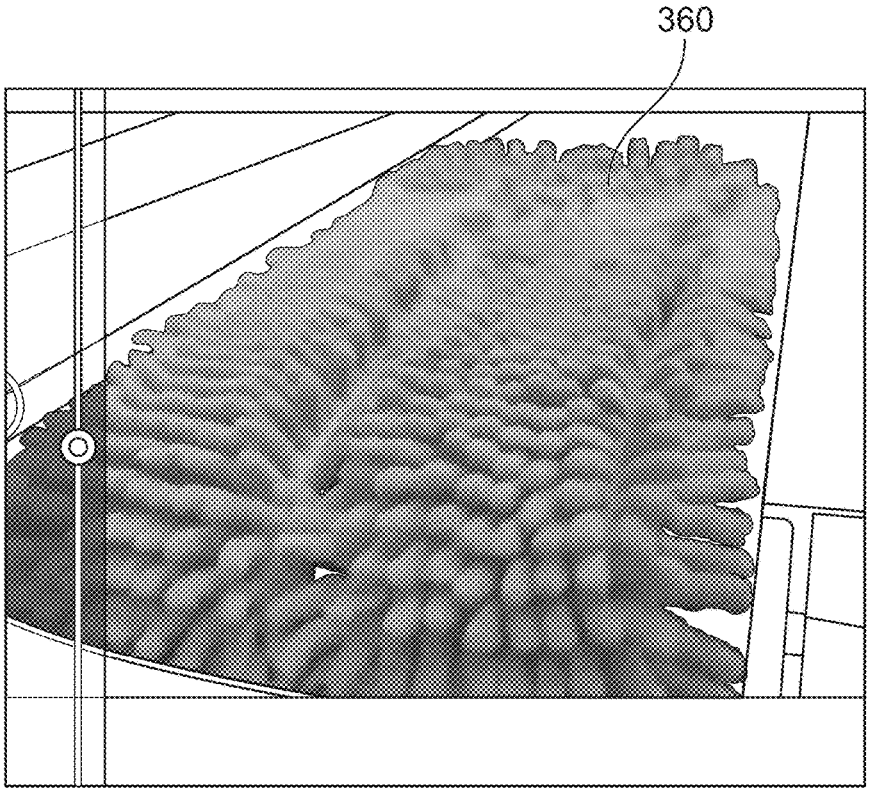
FIG. 13 shows an embodiment of a roller device.

FIG. 13 shows an embodiment of the roller device. Specifically, the cloth 430 is shown.

Figure 14:
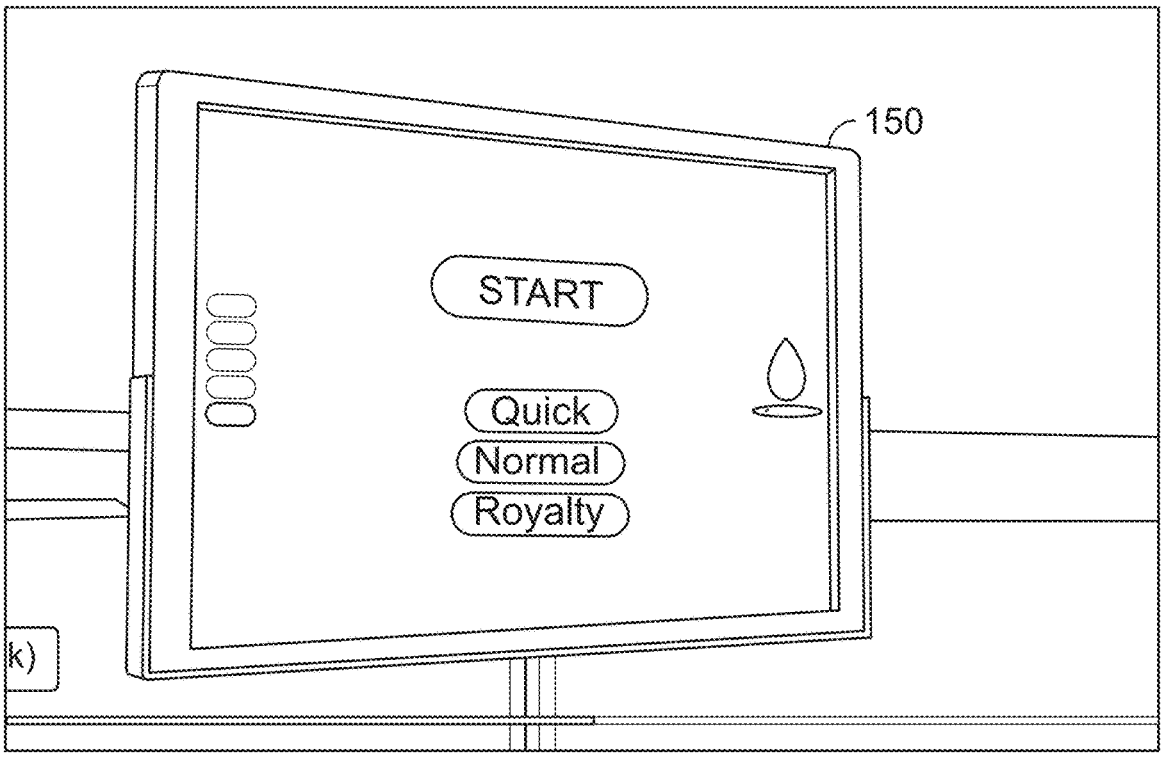
FIG. 14 shows an embodiment of a controller.

FIG. 14 shows an embodiment of a controller. The controller 150 may be used to determine operations of the system 100, 110'. As non-limiting examples, the controller may be used by a user to select, but is not limited to, a type of wash, water temperature, brush pressure, etc. The controller may be touch screen. The controller may comprise a computing system disclosed further in FIG. 20. The system 110, 110' may also comprise an artificially intelligent enabled system-on-module/system-on-chip (SOC/SOM) processing core 1607. More specifically, a plurality of sensors 610 (shown in FIG. 6) may be further included within the system 110, 110' such as, but not limited to, in and around the seating area to determine such features of the individual within the system 110, 110' as weight, height, physical dimensions, etc., wherein the processing core collects this information to determine a functional setting for the individual such as, but not limited to, brush placement against the individual's skin. The types of sensors 610 included are non-limiting, but may include a scale, sensors to take images, thermostats, etc.

The controller 150 may also control a lighting system 621. In an embodiment, the lighting system comprises a plurality of lights 620. As a non-limiting example, the plurality of lights may be light emitting diodes (LEDS) where the frequency of the light emission may range from at least an infrared light frequency, visible light frequency to an ultraviolet light frequency. The visible light frequency may be used to provide further visual illumination for the individual. The infrared light frequency may be used to provide chromotherapy to provide color therapy, which is an alternative holistic health treatment used to improve health and later the individual's mood. The ultraviolet light frequency may be used to clean the inner surfaces of the system after or prior to use of the system 100, 100'.

Figure 15:
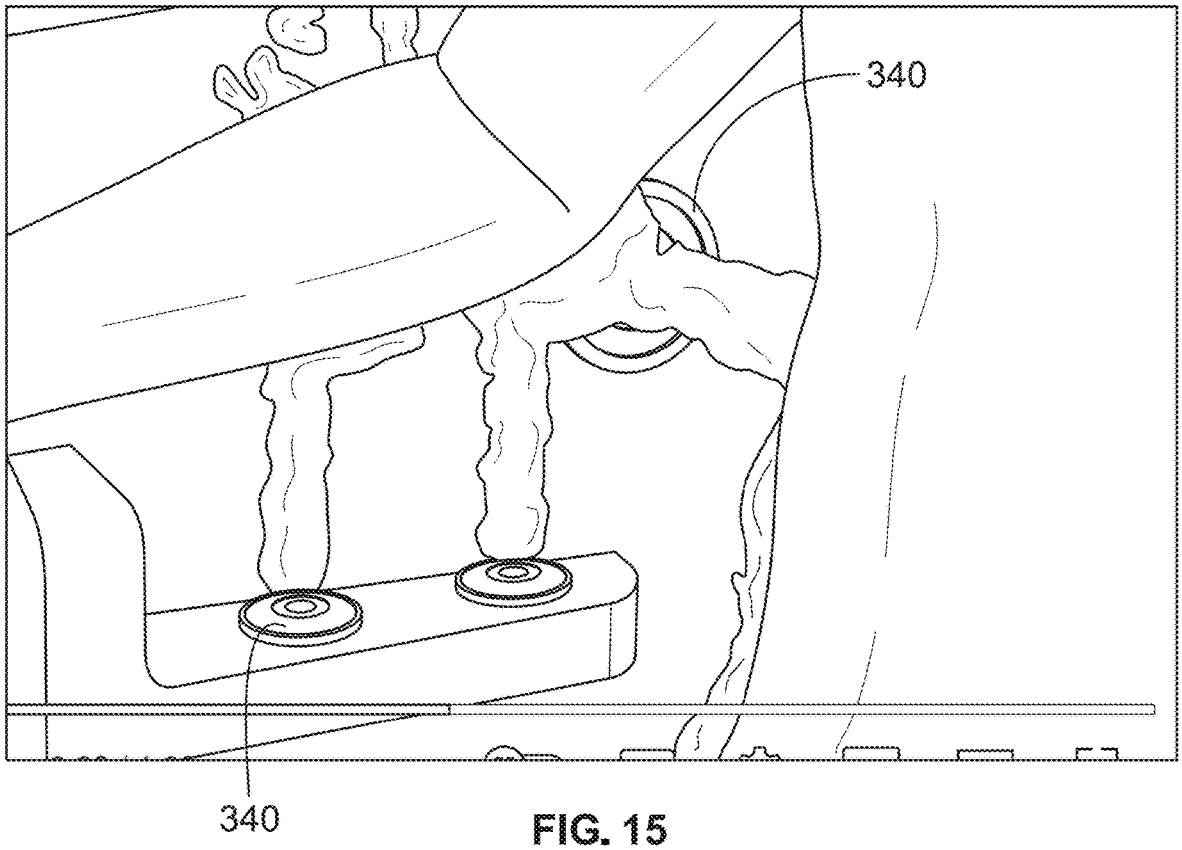
FIG. 15 shows an embodiment of water jets within the enclosure.
Figure 16:
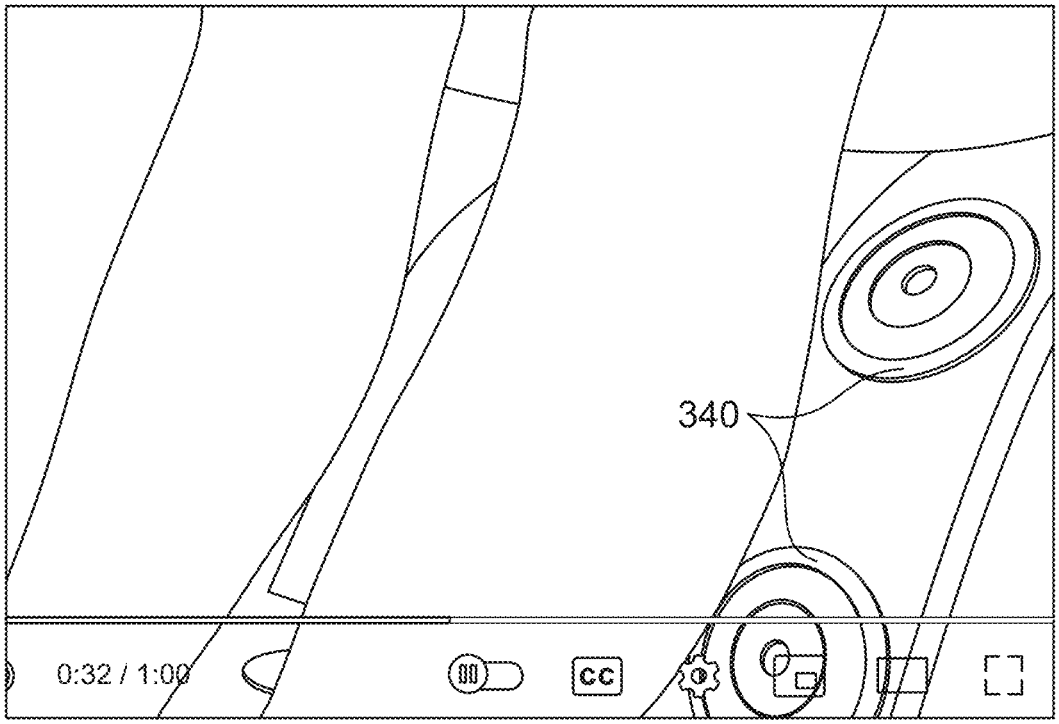
FIG. 16 shows an embodiment of water jets at another location within the enclosure.

FIGS. 15 and 16 show embodiments of water jets within the enclosure. Based on a setting selected or preprogrammed, such as by the AI processing core 1607, the water flow may be provided. The water flow is non-limiting as variations may include, but is not limited to, water pressure, duration of water flow, variability of the water flow or pressure, sequence when considering other water jets, etc.

Figure 17:
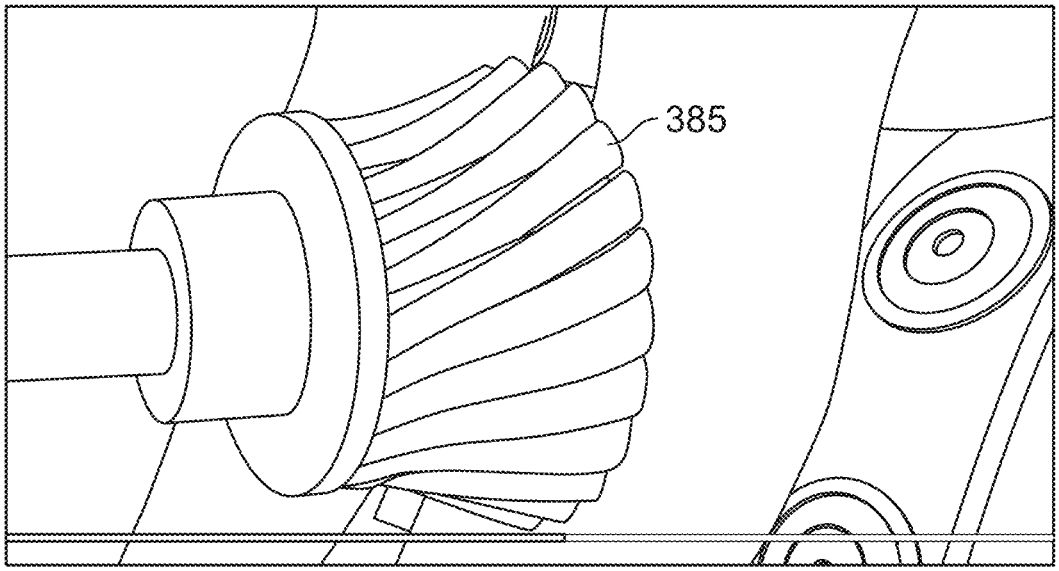
FIG. 17 shows an embodiment of another scrubber extended from the enclosure to reach the user.

FIG. 17 shows an embodiment of a scrubber extended from the enclosure to reach the user. As shown, the handle 390 may extend from the inner wall to a distance so that the scrubber 385 or brush makes contact with the individual. As disclosed above, the distance the handle 390 extends may be preprogrammed in (such as once dimensions of the individual are already known) or determined by the AI core processor 1607.

FIG. 18 shows an embodiment of a side view of the enclosure. A drying system 150 may be provided. The drying system may provide heated air when the individual is still within the system 100, 100'. In another embodiment, the drying system may be used to dry the system 100, 100' once the individual has left the enclosure 110, 110'. In another embodiment, the lighting system with the plurality of lights 620 may dry the system 110, 110'. Though not shown, when air is used, a blowing device may be part of the drying system 150.

FIG. 19 is a process block for a method disclosed herein. As disclosed, the method provides for controlling a bathing process of an enclosure having at least one movable component that can be opened for an individual to be placed within the enclosure and then closed when the individual is within the enclosure by controlling a cleaning system within the enclosure to at least one of dispense a liquid through at least one opening within the structure and to physically contact the user with at least one brush, with a processor that is part of a controller that has a user interface.

Figure 20:
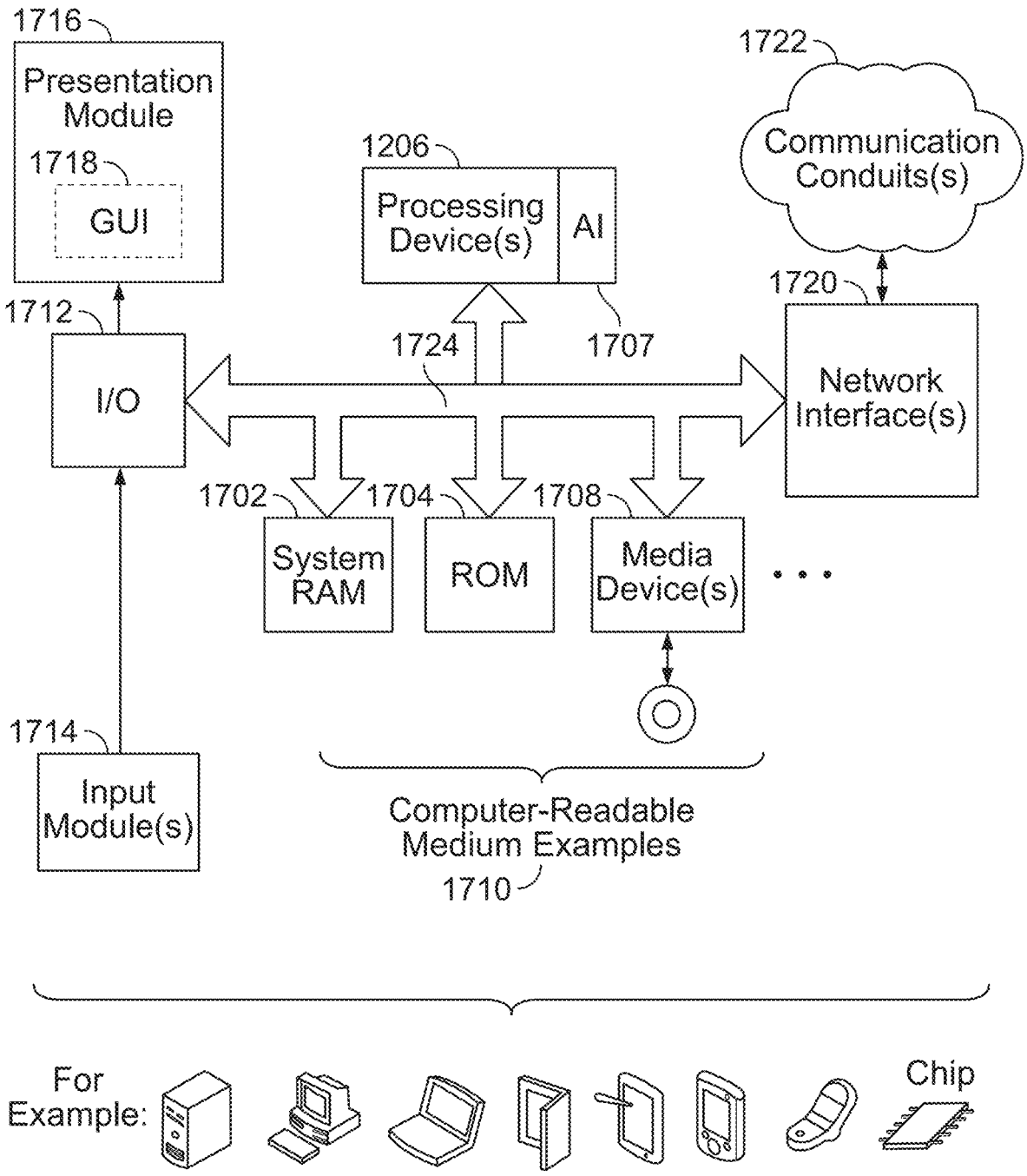
FIG. 20 shows a block diagram of an exemplary computer system.

Referring now to FIG. 20, a block diagram of an exemplary computer system, device, or computing functionality, 1600 useful for implementing various aspects the processes disclosed herein, in accordance with one or more embodiments is shown. The computing device may be part hardware or equipment used to provide for the pattern to be moved cyclically in a constant and continuous pattern. In a basic configuration, a computing device 1600 may include any type of stationary computing device or a mobile computing device. The computing device may be part of the additive manufacturing device as disclosed above. The computing device may include one or more processors 1606 and system memory 1610 in a hard drive, or media device, 1608. As discussed above, one of the processors may be the AI core processor 1607. Depending on the exact configuration and type of computing device, system memory 1610 may be volatile (such as RAM), non-volatile (such as read only memory (ROM), flash memory, and the like) or some combination of the two. A system memory 1610 may store an operating system, one or more applications, and may include program data for performing flight, navigation, avionics, power managements operations such as for space operations.

The computing device 1600 may carry out one or more blocks of a process and or the additive manufacturing processes described herein. The computing device may also have additional features or functionality. As a non-limiting example, the computing device may also include additional data storage devices (removable and/or non-removable) such as, for example, magnetic disks, optical disks, or tape. The computer storage media may include volatile and non-volatile, non-transitory, removable and non-removable media implemented in any method or technology for storage of data, such as computer readable instructions, data structures, program modules or other data. The system memory, removable storage and non-removable storage are all non-limiting examples of computer storage media. The computer storage media may include, but is not limited to, RAM, ROM, Electrically Erasable Read-Only Memory (EEPROM), flash memory or other memory technology, compact-disc-read-only memory (CD-ROM), digital versatile disks (DVD) or other optical storage, magnetic cassettes, magnetic tape, magnetic disk storage or other magnetic storage devices, or any other physical medium which can be used to store the desired data, and which can be accessed by computing device. Any such computer storage media may be part of device.

The computing device may also include or have interfaces 1612 for input device(s) 1614 (not shown) such as a keyboard, mouse, pen, voice input device, touch input device, etc. The computing device 1600 may include or have interfaces for connection to output device(s) such as a display, speakers, etc. The computing device may include a peripheral bus for connecting to peripherals. The computing device 1600 may also connect to a presentation module 1616 and a graphical user interface 1618. Computing device 1600 may contain communication connection(s) 1622 that allow the device to communicate with other computing devices, such as over a network or a wireless network via a network interface 1620. By way of example, and not limitation, communication connection(s) may include wired media such as a wired network or direct-wired connection, and wireless media such as acoustic, radio frequency (RF), infrared and other wireless media. The computing device may include a network interface card to connect (wired or wireless) to a network.

Computer program code for carrying out operations described above may be written in a variety of programming languages, including but not limited to a high-level programming language, such as C or C++, for development convenience. In addition, computer program code for carrying out operations of embodiments described herein may also be written in other programming languages, such as, but not limited to, interpreted languages. Some modules or routines may be written in assembly language or even micro-code to enhance performance and/or memory usage. It will be further appreciated that the functionality of any or all of the program modules may also be implemented using discrete hardware components, one or more application specific integrated circuits (ASICs), or a programmed Digital Signal Processor (DSP) or microcontroller. A code in which a program of the embodiments is described can be included as a firmware in a RAM, a ROM and a flash memory. Otherwise, the code can be stored in a tangible computer-readable storage medium such as a magnetic tape, a flexible disc, a hard disc, a compact disc, a photo-magnetic disc, a digital versatile disc (DVD).

The embodiments may be configured for use in a computer or a data processing apparatus which includes a memory, such as a central processing unit (CPU), a RAM and a ROM as well as a storage medium such as a hard disc.

The "step-by-step process" for performing the claimed functions herein is a specific algorithm, and may be shown as a mathematical formula, in the text of the specification as prose, and/or in a flow chart. The instructions of the software program create a special purpose machine for carrying out the particular algorithm. Thus, in any means-plus-function claim herein in which the disclosed structure is a computer, or microprocessor, programmed to carry out an algorithm, the disclosed structure is not the general-purpose computer, but rather the special purpose computer programmed to perform the disclosed algorithm.

A general-purpose computer, or microprocessor, may be programmed to carry out the algorithm/steps for creating a new machine. The general-purpose computer becomes a special purpose computer once it is programmed to perform particular functions pursuant to instructions from program software of the embodiments described herein. The instructions of the software program that carry out the algorithm/steps electrically change the general-purpose computer by creating electrical paths within the device. These electrical paths create a special purpose machine for carrying out particular algorithm/steps.

Embodiments disclosed herein provide for several components that collectively contribute to its functionality and user experience. A lower portion with rolling scrubbers is provided to cater to the individual's back and lower extremities. These scrubbers incorporate a gentle yet effective massaging motion that aids in exfoliation and cleansing. The rolling scrubbers move in synchronized patterns to cover a wide area, ensuring thorough coverage for improved hygiene. An upper portion with rotating scrubbers provides for the individual's front and upper body. These scrubbers may utilize a circular motion to target areas such as the chest, shoulders, and arms. The rotation mechanism is designed to mimic the motion of hand washing, ensuring a comprehensive cleansing experience.

To ensure a personalized and tailored experience, embodiments disclosed herein include sensors. The sensors may detect the individual's body contours and dimensions, allowing the scrubbers to adjust their motions accordingly. This feature not only enhances the effectiveness of the scrubbing process but also ensures user safety and comfort. By way of its computing system, embodiments are able to operate autonomously. Hence, embodiments may regulate water or liquid temperature, control water or liquid entry and exit, manage soap dispensing, and activate the cleaning subsystem, such as but not limited to the scrubbing mechanisms disclosed herein. The individual's bathing can be customized through the intuitive electronic control panel.

Unless otherwise defined, all terms (including technical and scientific terms) used herein have the same meaning as commonly understood by one of ordinary skill in the art to which embodiments belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

In particular, unless specifically stated otherwise as apparent from the discussion, it is appreciated that throughout the description, discussions utilizing terms such as "processing" or "computing" or "calculating" or "determining" or "displaying" or the like, refer to the action and processes of a computer system, or similar electronic computing device, that manipulates and transforms data represented as physical (electronic) quantities within the computer system's registers and memories into other data similarly represented as physical quantities within the computer system memories or registers or other such data storage, transmission or display devices.

The terminology used herein is for the purpose of describing particular embodiments only and is not intended to be limiting. As used herein, the singular forms "a," "an." and "the" are intended to include the plural forms as well, unless the context clearly indicates otherwise. Furthermore, to the extent that the terms "including." "includes," "having." "has," "with." or variants thereof are used in either the detailed description and/or the claims, such terms are intended to be inclusive in a manner similar to the term "comprising." Moreover, unless specifically stated, any use of the terms first, second, etc., does not denote any order or importance, but rather the terms first, second, etc., are used to distinguish one element from another. As used herein the expression "at least one of A and B." will be understood to mean only A, only B, or both A and B.

While various disclosed embodiments have been described above, it should be understood that they have been presented by way of example only, and not limitation. Numerous changes, omissions and/or additions to the subject matter disclosed herein can be made in accordance with the embodiments disclosed herein without departing from the spirit or scope of the embodiments. Also, equivalents may be substituted for elements thereof without departing from the spirit and scope of the embodiments. In addition, while a particular feature may have been disclosed with respect to only one of several implementations, such feature may be combined with one or more other features of the other implementations as may be desired and advantageous for any given or particular application. Furthermore, many modifications may be made to adapt a particular situation or material to the teachings of the embodiments without departing from the scope thereof.

Further, the purpose of the foregoing Abstract is to enable the U.S. Patent and Trademark Office and the public generally and especially the scientists, engineers and practitioners in the relevant art(s) who are not familiar with patent or legal terms or phraseology, to determine quickly from a cursory inspection the nature and essence of this technical disclosure. The Abstract is not intended to be limiting as to the scope of the present disclosure in any way.

Therefore, the breadth and scope of the subject matter provided herein should not be limited by any of the above explicitly described embodiments. Rather, the scope of the embodiments should be defined in accordance with the following claims and their equivalents.

I claim:

1. A bathing system comprising:

an enclosure having a base and a movable enclosure portion operably hinged or slidably coupled to the enclosure to permit opening for placement of an individual within the enclosure and to close around the individual, the enclosure defining a head opening sized to allow a head of the individual to remain outside the enclosure during operation;

a resting support mounted to the base within the enclosure and configurable between a generally vertical sitting position and a prone position;

a first rolling device disposed at a base of the resting support and a second rolling device disposed on an inside surface of the movable enclosure portion, each rolling device including a conveying element carrying a textile cleaning medium, the first and second rolling devices positioned to simultaneously contact opposing anterior and posterior sides of the individual in the prone position;

a plurality of flexible straps spanning each conveying element to retain the textile cleaning medium on the conveying element, each flexible strap including an internal fluid passage with a plurality of lateral discharge orifices to dispense liquid from the strap toward the individual, and the straps being fluidly coupled to a pump such that liquid pressure and flow through the straps are variable under electronic control;

at least one extendable and retractable scrubbing device mounted to an inside surface of the enclosure, the scrubbing device having a telescoping handle terminating at a brush and a force sensor configured to limit contact pressure applied to the individual;

and a controller comprising a processor configured to receive signals from one or more sensors indicative of body dimensions of the individual and, responsive thereto, to generate a user-specific cleaning plan that controls at least extension of the scrubbing device, liquid pressure and temperature, rotational speed and direction of the rolling devices, and operation of at least one powered actuator coupled between the enclosure and a support structure to tilt or rotate the enclosure to facilitate ingress and egress.

2. The system of claim 1, wherein each flexible strap is a removable tubular member formed with the internal fluid passage and the plurality of lateral discharge orifices, and wherein the controller varies liquid pressure delivered through the straps independently of liquid delivered to water jets in the enclosure.

3. The system of claim 1, wherein the first and second rolling devices are driven in counterrotating directions during a cleaning cycle to scrub the anterior and posterior sides simultaneously.

4. The system of claim 1, wherein the controller comprises an artificial intelligence system nonmodule configured to compute the user specific cleaning plan from sensor data including at least weight measured by a scale at the resting support and at least one captured image of the individual.

5. The system of claim 1, wherein the scrubbing device automatically retracts flush with the inside surface when not in use and the force sensor enforces a maximum allowable contact pressure threshold.

6. The system of claim 1, further comprising a powered base configured to tilt the enclosure about a horizontal axis and to rotate the enclosure about a vertical axis, and optionally to vibrate the enclosure.

7. The system of claim 1, wherein the head opening includes a liquid blocking gasket and a headrest having a face aperture permitting a prone facendown position with breathing clearance.

8. The system of claim 1, wherein at least one armrest of the resting support incorporates liquid dispensing nozzles.

9. The system of claim 1, further comprising a drainage system including a drain, a trap, and a removable filter to collect debris from used liquid within the enclosure.

10. The system of claim 1, further comprising a drying system configured to direct heated air toward the individual and to dry interior surfaces of the enclosure after the individual exits.

11. The system of claim 1, further comprising a lighting system including visible light emitters for illumination, infrared emitters to provide chromotherapy, and ultraviolet emitters to sanitize the enclosure in an interlocked post and use cycle when the enclosure is vacant.

12. The system of claim 1, wherein the rotational directions of the first and second rolling devices are selected to reduce net lateral shear on skin over bony prominences of the individual.

13. The system of claim 1, wherein the flexible straps both retain the textile cleaning medium on the conveying element and deliver liquid through the internal fluid passage and further include quick release connectors to facilitate removal of the textile cleaning medium for laundering or replacement.

14. The system of claim 1, wherein the resting support includes a seat and a back support jointly adjustable from approximately 0° (prone) to approximately 90° (sitting).

15. The system of claim 1, wherein the one or more sensors comprise at least a scale integrated into the resting support and at least one optical sensor configured to capture an image of the individual for determination of body dimensions used by the controller to set extension of the scrubbing device and positions of the rolling devices.

16. A method of bathing an individual in an enclosure having a base and a movable enclosure portion operably hinged or slidably coupled to the enclosure, comprising:

receiving, by a controller, sensor data indicative of body dimensions of the individual;

generating, by the controller, a user-specific cleaning plan specifying at least liquid temperature and pressure, extension of an extendable scrubbing device, rotational speeds and directions of first and second rolling devices mounted respectively at a base of a resting support and on an inside surface of the movable enclosure portion, and a tilt or rotation position of the enclosure produced by at least one powered actuator;

placing the individual on the resting support and positioning the individual in a prone or sitting position with a head outside the enclosure through a head opening;

closing the movable enclosure portion around the individual while maintaining the head outside the head opening;

simultaneously driving the first and second rolling devices to contact opposing sides of the individual while delivering liquid through flexible straps spanning each rolling device, the flexible straps having internal fluid passages and lateral discharge orifices;

operating the extendable scrubbing device with force-limited contact pressure;

and after cleaning, performing a drying cycle and, when the enclosure is vacant, a sanitizing cycle using ultraviolet emitters.

* * * * *